US005673743A

United States Patent [19]

Kawamoto et al.

[11] Patent Number: 5,673,743

[45] Date of Patent: Oct. 7, 1997

[54] METHOD OF MOLDING COMPLETE CORE FROM BASE CORE AND BONDED CORE

[75] Inventors: Hiroaki Kawamoto; Hidekazu Ito; Yuji Nishiyama; Masamitsu Kenmochi; Sadao Kitazawa; Makoto Iwata, all of Toyota, Japan

[73] Assignee: Toyota Jidosha Kabushiki Kaisha, Aichi-ken, Japan

[21] Appl. No.: 577,472

[22] Filed: Dec. 22, 1995

[30] Foreign Application Priority Data

| | | | |
|---|---|---|---|
| Dec. 26, 1994 | [JP] | Japan | 6-322219 |
| Aug. 30, 1995 | [JP] | Japan | 7-221944 |
| Nov. 13, 1995 | [JP] | Japan | 7-294476 |

[51] Int. Cl.[6] ..... B22C 9/10; B22C 7/06

[52] U.S. Cl. ..... 164/24; 164/28; 164/228

[58] Field of Search ..... 164/24, 28, 228, 164/230

[56] References Cited

U.S. PATENT DOCUMENTS

| | | | |
|---|---|---|---|
| 4,809,763 | 3/1989 | Schilling | 164/28 |
| 4,989,661 | 2/1991 | Erana | 164/24 |
| 5,201,811 | 4/1993 | Lebold et al. | 164/28 |

FOREIGN PATENT DOCUMENTS

| | | | |
|---|---|---|---|
| 3445732 A1 | 6/1986 | Germany . | |
| 60-45982 | 10/1985 | Japan | 164/28 |
| 63-33145 | 2/1988 | Japan | 164/228 |
| B2 63-22900 | 5/1988 | Japan . | |
| U 64-27151 | 2/1989 | Japan . | |
| A-775132 | 5/1957 | United Kingdom . | |

OTHER PUBLICATIONS

Patent Abstracts of Japan, vol. 008, No. 276 (M-346), 18 Dec. 1984 & JP-A-59147744 (Naniwa Seisakusho:KK), 24 Aug. 1984.

*Primary Examiner*—Joseph J. Hail, III
*Assistant Examiner*—I.-H. Lin
*Attorney, Agent, or Firm*—Oliff & Berridge

[57] ABSTRACT

A process of core molding is disclosed, which permits increasing the positioning accuracy of a base core and a bonded core relative to each other and also avoids handling the first molded base core outside the die to preclude such trouble as breakage of the common die. By the process, a complete core is obtained, which comprises a base core and a bonded core positioned in and bonded to the base core. The base core is molded in a molding space which is defined by engaging a die element and a common die with each other. After removing the die element from the common die while leaving the molded base core in the common die, a different die element is engaged with the common die to define a different molding space for molding a bonded core. The bonded core is bonded to the base core as it is molded.

7 Claims, 15 Drawing Sheets

METHOD OF MOLDING COMPLETE CORE FROM BASE CORE AND BONDED CORE

BACKGROUND OF THE INVENTION

1. Field of the Invention

This invention relates to processes of core molding to obtain a complete core comprising a base core and a bonded core pertaining thereto.

2. Description of the Prior Art

A process of core molding of the pertaining type is disclosed in, for instance, Japanese Patent Publication No. 63-22900. In the disclosed technique, a portion of complete core is first molded as a base core in a first molding step. The base core thus molded is taken out from a first die and is set in a second die by positioning the base core with respect to the second die. Core material sand is then charged into the second die and hardened by passing catalytic gas for hardening, thus obtaining the remaining molding of a complete core, the remaining molding being bonded to the base core molded before as the bonded core is molded. In this way, the pertaining type complete core is molded.

In the prior art as shown, for setting the base core having been molded in the first molding step in the second die by positioning the base core therein, a clearance is provided between the base core and the second die. This clearance is necessary for setting the base core in the second die. However, this clearance causes fluctuations of the positioning accuracy, thus causing dimensional accuracy fluctuations of a cast product obtained by using the complete core molded by the above process. In the prior art, therefore, it is extremely difficult to manufacture a core for a cast product requiring high thickness accuracy, such as a wall part between a bore and a water jacket of an automotive engine cylinder block. Besides, in the prior art technique, a step of taking out the base core molded in advance from the first die is required. The base core that has been taken out from the first die is handled outside the die, thus giving rise to such trouble as breakage of the base core.

SUMMARY OF THE INVENTION

A first object of the invention is to increase the positioning accuracy of the base core and the bonded core to each other and to also avoid handling the base core molded beforehand outside the die so as to preclude such trouble as breakage of the base core, by permitting the die element used in combination with the common die to be changed while leaving the base core molded beforehand in the common die, so that the bonded core is molded with the different die element and the common die to obtain the complete core such that the bonded core is bonded to the base core as it is molded.

A second object of the invention is to permit ready removal of the die element for the bonded core without interfering with the base core.

A third object of the invention is to prevent cracking of the complete core when opening the common die.

A fourth object of the invention is to preclude the use of commonly termed loose pieces.

According to a first aspect of the invention, a process of molding a complete core comprising a base core and a bonded core bonded thereto is provided, which features the steps of preparing a common die, a first die element defining a first molding space corresponding to the base core when engaged with the common die, and a second die element defining a second molding space including the first molding space and a space corresponding to the bonded core when engaged with the common die, engaging the first die element with the common die, molding the base core by charging a core material into the first molding space, removing the first die element from the common die with the base core left in the common die and then engaging the second die element with the common die, and molding the bonded core by charging the core material into the second molding space such that the bonded core is bonded to the base core.

In this process, the bonded core is formed in the second molding space while leaving the base core molded beforehand in the common die. The positioning accuracy of the base core and the bonded core with respect to each other thus can be improved, so that the process is suited for the molding of the core for a cast product requiring high dimensional accuracy. Besides, the base core molded beforehand is not taken out of and handled outside the die, so that it is possible to avoid breakage of the base core.

According to a second aspect of the invention, in the process of core molding according to the first aspect of the invention, some of a plurality of core material charging ports formed in the common die are closed by the first die element when the first die element is engaged with the common die.

In the base core molding, the core material is not charged from the charging port that are held closed by the first die element but is charged from the charging ports that are not closed, so that the base core is molded. In the subsequent molding step using the second die element, the core material is charged from the former charging die, so that the bonded core is molded. At this time, the latter charging ports are held closed by the base core, and the shape thereof is thus held unchanged. With this arrangement, the second die element can be simplified in shape, so that it can be removed without interfering with the base core.

According to a third aspect of the invention, in the process according to the first aspect of the invention, when taking out the complete core from the common die by opening the common die, a push pin is held at an intermediate position in a stroke of opening the common die, and the second die element is removed after opening the common die.

It is thus possible to preclude such trouble as cracking of the complete core when opening the common die.

According to a fourth aspect of the invention, in the process according to the first aspect of the invention, at least either the first die element or the second die element includes a contracting mechanism operable such that the die element with the contracting mechanism is removed without interfering with the molded core.

With this arrangement, even where an undercut is present which usually causes interference between the die and the molded core and prevents die element removal, it is possible to obtain a molded core without use of any loose piece which reduces the productivity.

BRIEF DESCRIPTION OF THE DRAWINGS

The above and other objects, features and advantages of the invention will become more apparent from the detailed description of the preferred embodiments given hereinunder when the same is read with reference to the accompanying drawings, in which.

DETAILED DESCRIPTION OF THE PREFERRED EMBODIMENTS

Preferred embodiments of the invention will now be described.

In the following embodiments, the invention is applied to a technique of molding a core to be used for cylinder block casting. In this technique, so called cold box process is adopted. The cold box process is one in which silicate sand covered by phenol resin is used as a core material and hardened without heating but by utilizing a hardening reaction brought about by passing a catalytic gas (i.e., third class amine gas) at normal temperature, thus molding a core.

First Embodiment

Figure 1:
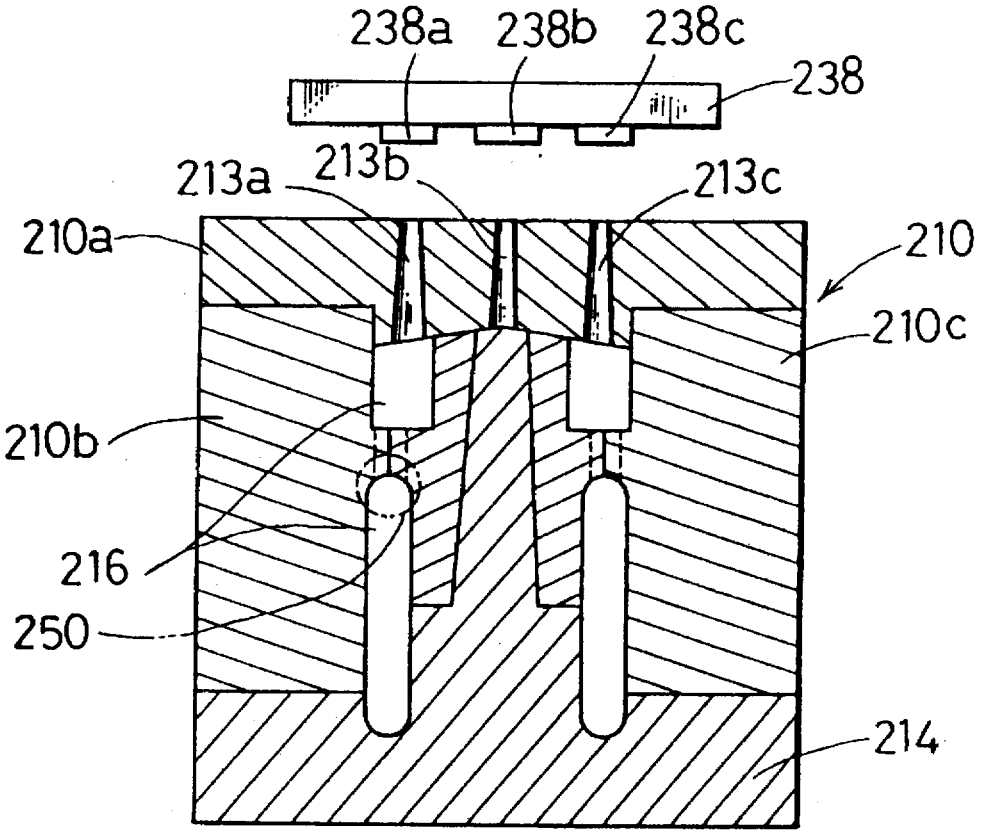
FIG. 1 is a sectional view showing a set-up in base core molding in a first embodiment of the invention.
Figure 7:
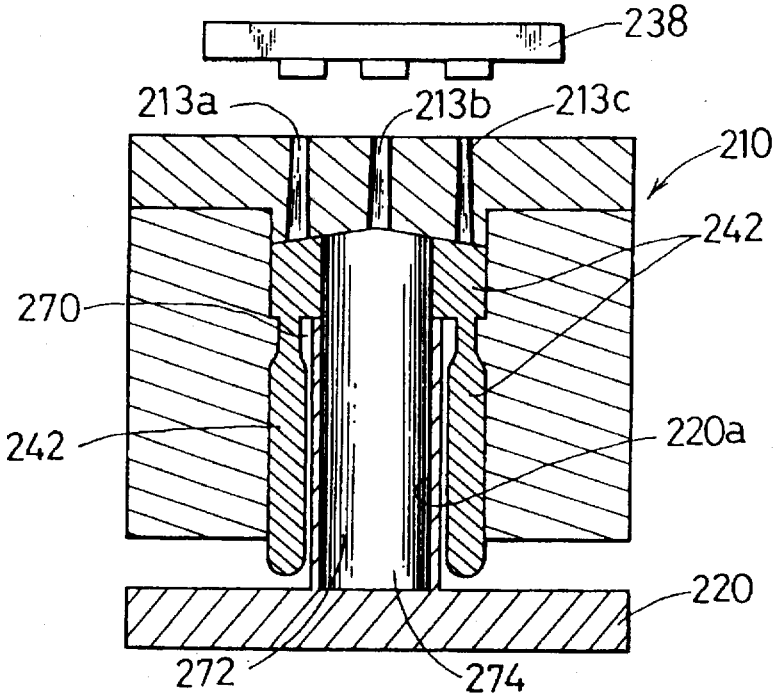
FIG. 7 is a sectional view showing a second die element along with the common die.

FIG. 1 illustrates a first molding step to obtain a base core in a first embodiment of the invention, and FIG. 7 shows a second molding step to obtain a bonded core bonded to the base core. In this embodiment, a common die 210 is used, which consists of three pieces, i.e., an upper die 210*a*, a left die 210*b* and a right die 210*c*. This common die 210 is opened with the upper die 210*a* moved upward from the illustrated position and the left die 210*b* moved to the left from the illustrated position. The right die 210*c* is held stationary. For a first molding step, a first die element 214 is engaged with the common die 210. When the first die element 214 is engaged with the common die 210, a first molding space 216 for molding a base die is formed between the two dies 214 and 210. In this embodiment, a water jacket core is molded as the base core. That is, the common die 210 has inner surfaces corresponding to outer surfaces of the water jacket core, while the first die element 214 has outer surfaces corresponding to inner surfaces of the water jacket core.

The upper die 210*a* has a plurality of core material charging ports 213*a*, 213*b* and 213*c* for charging a core material (i.e., resin-coated silicate sand). Of these charging ports, the charging port 213*b* is closed by the first die element 214 when the element 214 is engaged with the common die 210, while the other charging ports 213*a* and 213*c* are communicated with a first molding space 216 corresponding to the base core. Above the upper die 210*a*, a blow plate 238 is disposed for charging the core material into the first molding space 216. The blow plate 238 has a blow-out ports 238*a*, 238*b* and 238*c* formed at positions corresponding to the charging ports 213*a*, 213*b* and 213*c*.

After the first molding step, i.e., the step of molding the base core (i.e., water jacket core in this embodiment), the first die element 214 is removed downward with respect to the common die 210. At this time, the first die element 214 can not be removed while maintaining its shape. If the die element 214 is intended to be removed while maintaining its shape, it will interfere with a molded base core 242 (shown in FIG. 7) due to an undercut portion 250 thereof. Accordingly, the first die element 214 is provided with a contracting mechanism.

Figures 2A, 2B, 2C:
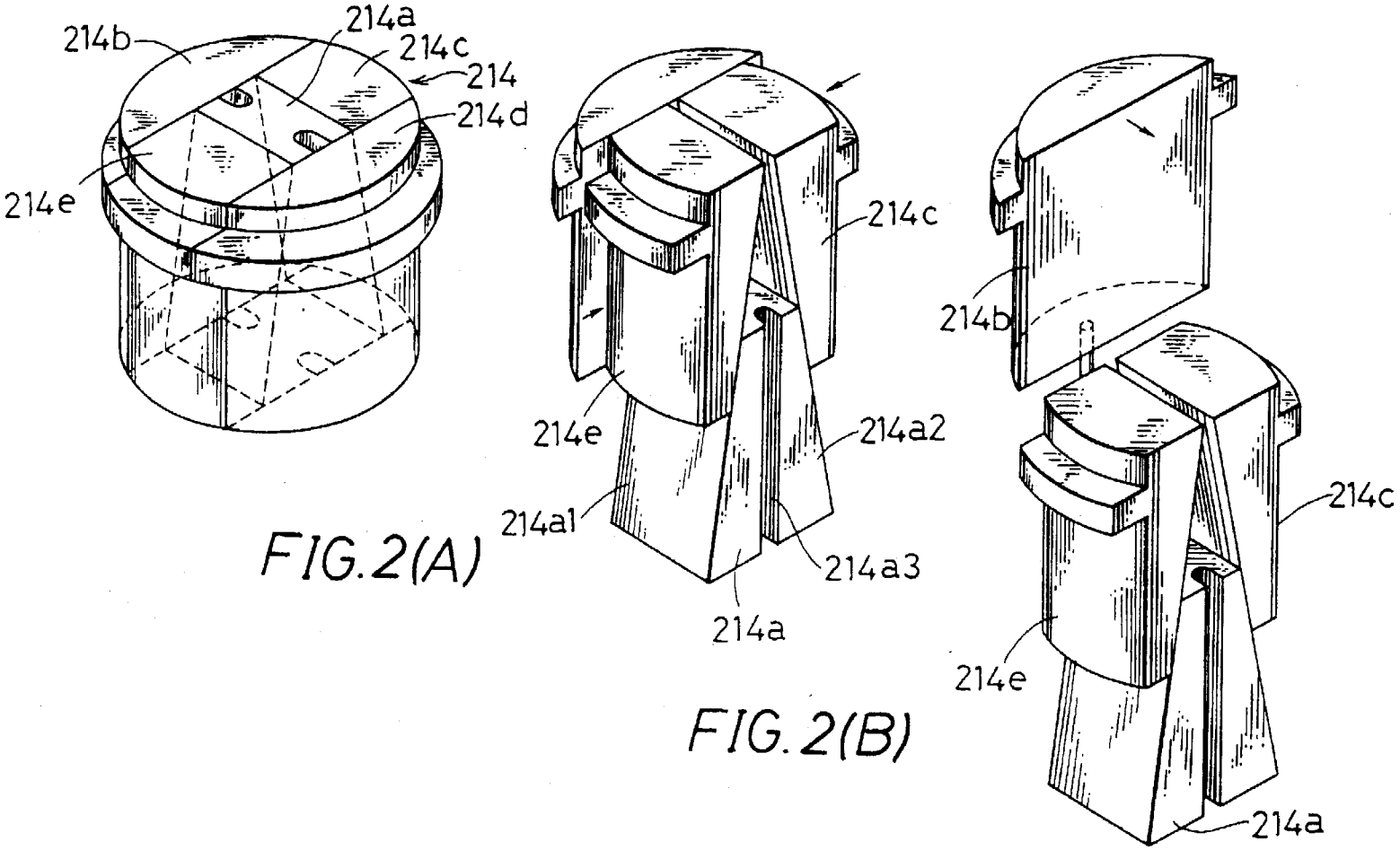
FIGS. 2(A) to 2(C) are perspective views showing a first die element.

FIGS. 2(A) to 2(C) schematically show the shape of an upper portion of the first die element 214. These figures illustrate the contracting mechanism briefly. FIG. 2(A) shows the first die element 214 in use. In this state, the outer shape of the element corresponds to the inner shape of the base core 242. The upper portion of the element 214 consists of a total of five pieces, i.e., a central member 214*a*, a left member 214*b*, a rear member 214*c*, a right member 214*d* and a front member 214*e*. The central member 214*a* has downwardly flaring front and rear surfaces 214*a*1 and 214*a*2. The front and rear members 214*e* and 214*c* can slide along the flaring surfaces 214*a*1 and 214*a*2. With this arrangement, by lowering only the central member 214*a*, as shown in FIG. 2(B), the front member 214*e* is displaced rearward, while the rear member 214*c* is displaced forward. Consequently, the upper portion of the first die element 214 is contracted in the back-and-forth direction. By further lowering the central member 214*a*, the front and rear members 214*e* and 214*c* are also lowered (see FIG. 2(C)). At this time, the front and rear members 214*e* and 214*c* do not interfere with the undercut portion 250 because the front member 214*e* has been shifted rearward while the rear member 214*c* has been shifted forward. After the front and rear members 214*e* and 214*c* have been lowered with respect to the left and right members 214*b* and 214*d*, the left member 214*b* is displaced to the right, while the right member 214*d* is displaced to the left. Consequently, the first die element 214 is contracted in the left-and-right direction. In this way, the upper portion of the first die element 214 is contracted in all directions, so that it can be removed from the base core 242 without interfering with the base core 242.

Figure 3:
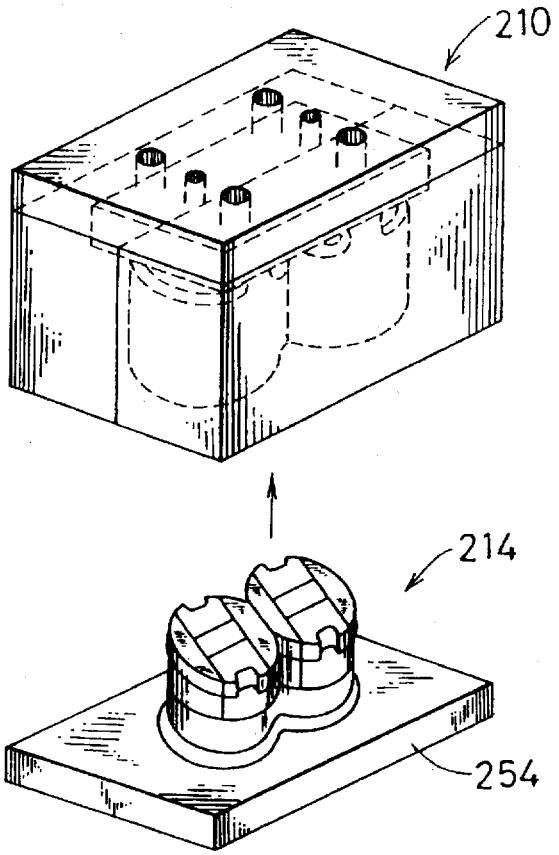
FIG. 3 is an exploded perspective view showing the first die element and a common die.
Figure 4:
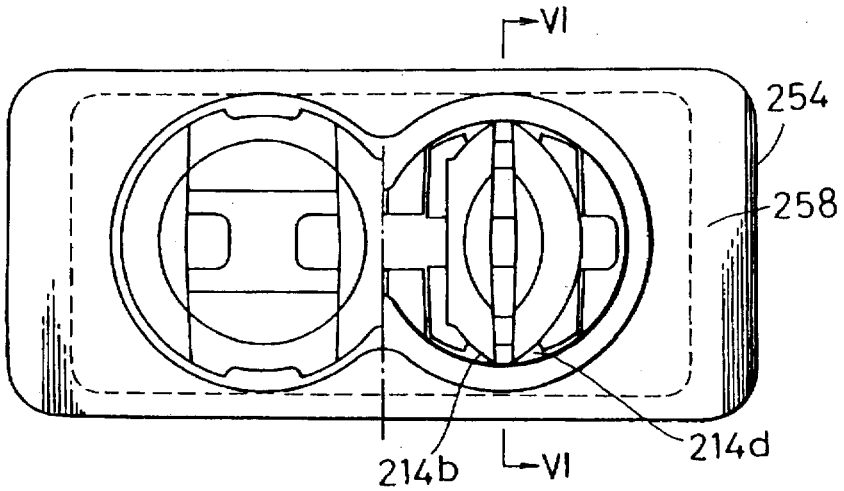
FIG. 4 is a plan view showing the first die element.
Figure 5:
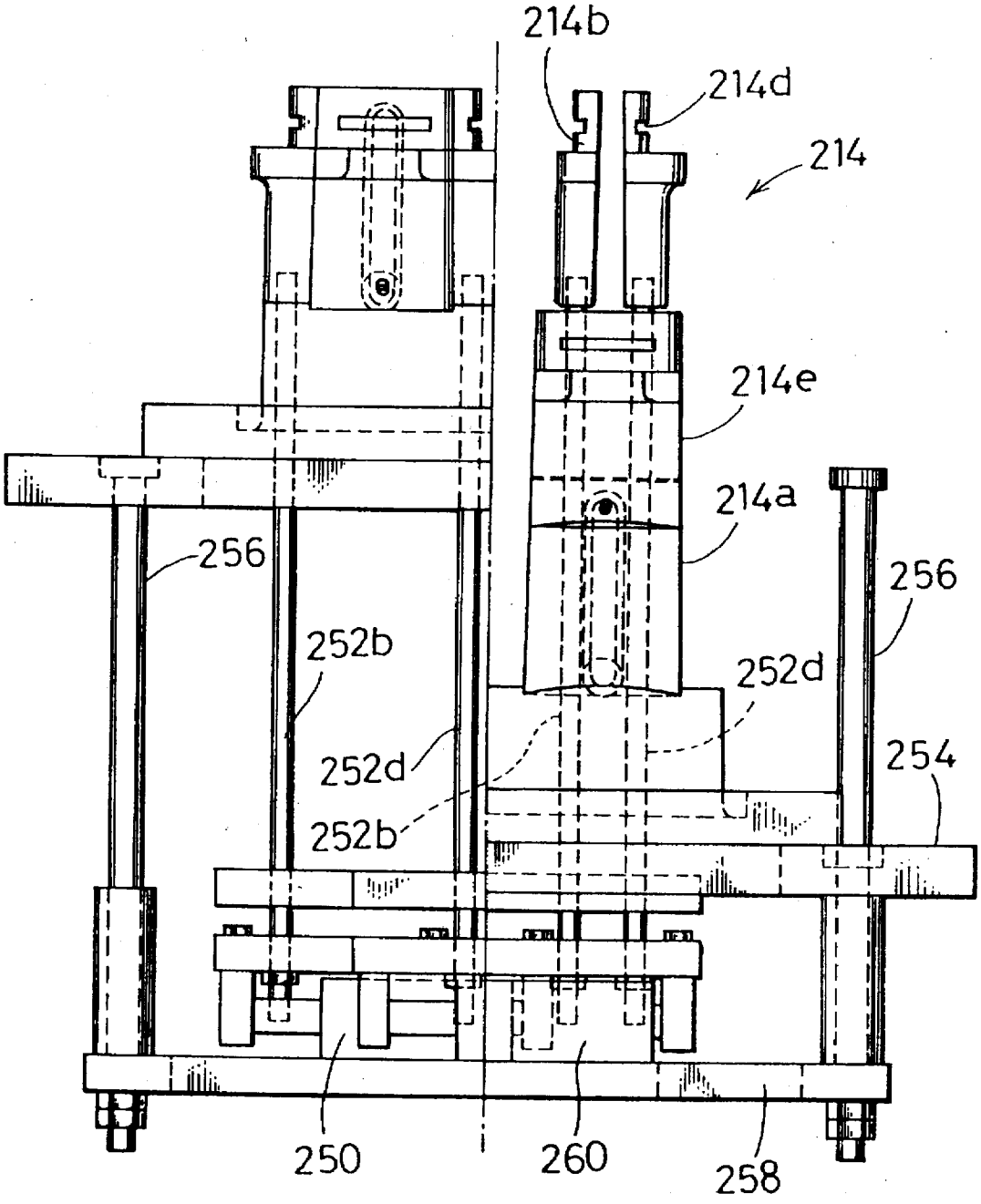
FIG. 5 is a side view showing the first die element.
Figure 6:
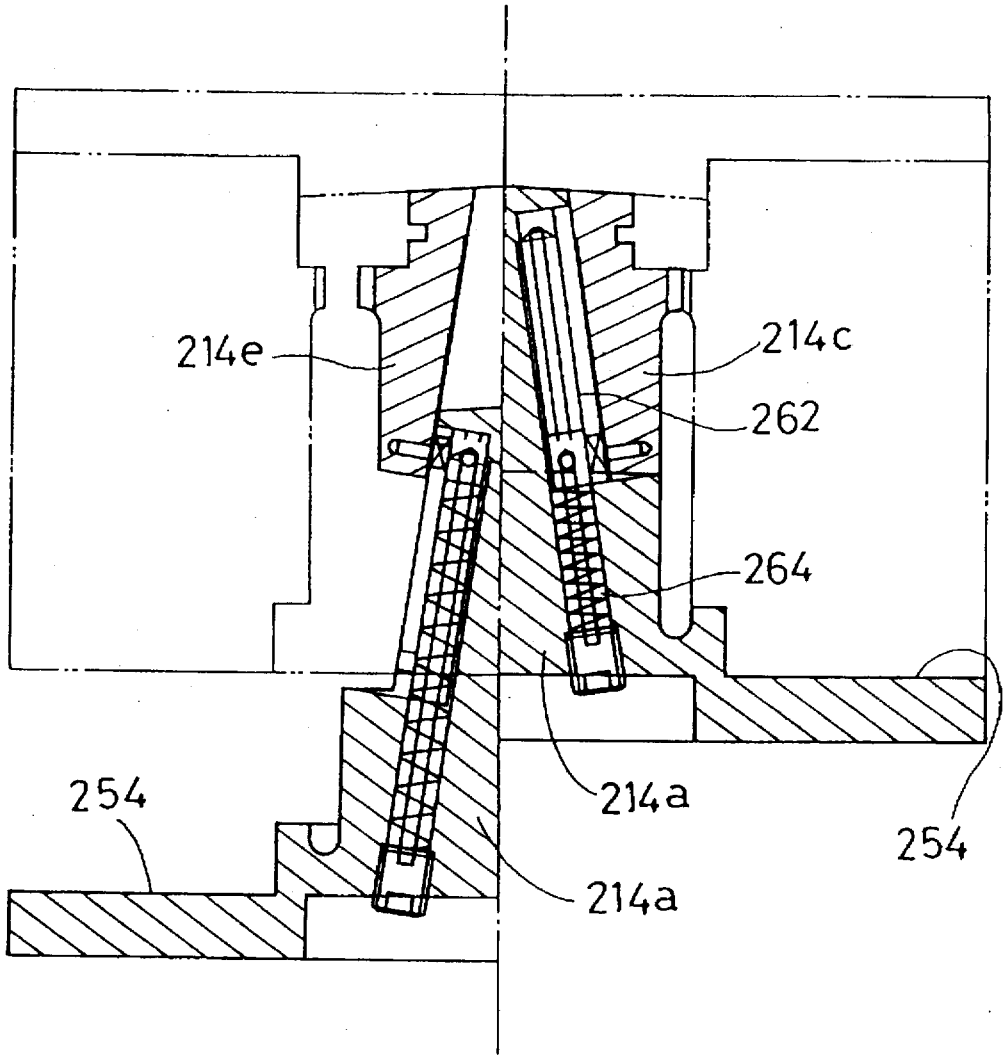
FIG. 6 is a sectional view taken along line VI—VI in FIG. 4.

FIG. 3 schematically shows the overall construction of the common die 210 and the first die element 214. This example is for molding the base core of a two-cylinder engine. FIG. 4 is a plan view showing the first die element 214, FIG. 5 is a side view showing the element, and FIG. 6 is a sectional view taken along line VI—VI in FIG. 4. In FIGS. 4 and 5, the right half shows the die element contracted, while the left half shows the element in use. In FIG. 6, the right half shows the element in use, and the left half shows the element contracted in the back-and-forth direction.

Referring to FIGS. 3 to 6, the first die element has a base 254 which can be moved by a die element shifting mechanism (not shown). The central member 214*a* noted above is secured to the base 254. The front member 214*e* is mounted via a mounting member 262 on the central member 214*a* such that it is slidable along the flaring surface 214*a*1. The mounting member 262 accommodates a spring 264. The rear member 214*c* is likewise mounted for sliding along the flaring surface 214*a*2.

A movable plate 258 is mounted on the base 254 for vertical displacement along a pair of guide pins 256. The movable plate 258 carries a pair of slide mechanisms 260 each mounted for each cylinder. The slide mechanism 260 has a pair of support rods 252*b* and 252*d*. The slide mechanism 260 can be driven between two positions, i.e., a position as shown in the left half of FIG. 5 in which the support rods 252*b* and 252*d* have been brought apart, and a position as shown in the right half in which the support rods 252*b* and 252*d* have been brought closer. The left member 214*b* is mounted on the upper end of the support rod 252*b*, and the right member 214*d* is mounted on the upper end of the support rod 252*d*. The support rods 252*b* and 252*d* upwardly penetrate the base 254 and grooves 214*a*3 (shown in FIG. 2(B)) of the central member 214*a*.

The operation of the above construction will now be described.

After completion of the first molding step for molding the base core, the base 254 of the first die element 214 is lowered by a die moving mechanism (not shown). The central member 214*a* which is secured to the base 254 is lowered in unison with the same. The front and rear members 214*e* and 214*c* are biased upward by the spring 264 and have their top positioned in contact with the upper die 210*a*. During the descent of the base 254, the descent of the left and right members 214*b* and 214*d* is prohibited with the movable plate 258 held at a constant height. Thus, only the central member 214*a* is lowered in unison with the base 254, and the front and rear members 214*e* and 214*c*, which are made slidable along the flaring surfaces 214*a*1 and 214*a*2 of the central member 214*a* via the mounting members 262, are caused to undergo parallel movement toward the center along the flaring surfaces 214*a*1 and 214*a*2. In FIG. 6, for the sake of convenience of illustration, the front member 214*e* is shown displaced toward the center, while the rear member 214*c* is not. The front and rear member 214*e* and 214*c* are upwardly biased by the springs 264 accommodated in the mounting members 262.

After the central member 214*a* has been lowered in unison with the base 254 down to its limit position determined by the mounting members 262, the base 254 is further lowered. As this occurs, the front and rear members 214*e* and 214*c* are also lowered. At this time, the first die element 214 has been contracted in the back-and-forth direction and does not interfere with the undercut portion 250. When the head portions of the front and rear members 214*e* and 214*c* are brought to be lower than the bottom of the left and right members 214*b* and 214*d*, the descent of the base 254 is interrupted. Then, the support rods 252*b* and 252*d* are brought closer to each other, that is, the left and right members 214*b* and 214*d* are contracted in the left-and-right direction, by the slide mechanism 260. Thereafter, the base 252 is lowered again. At this time, the movable plate 258 is lowered in unison with the base 254, and the first die element 214 is entirely lowered to be taken out from both the common die 210 and the base core 242. At this time, the left and right members 214*b* and 214*d* are held contracted and do not interfere with the undercut portion 250.

Figure 8:
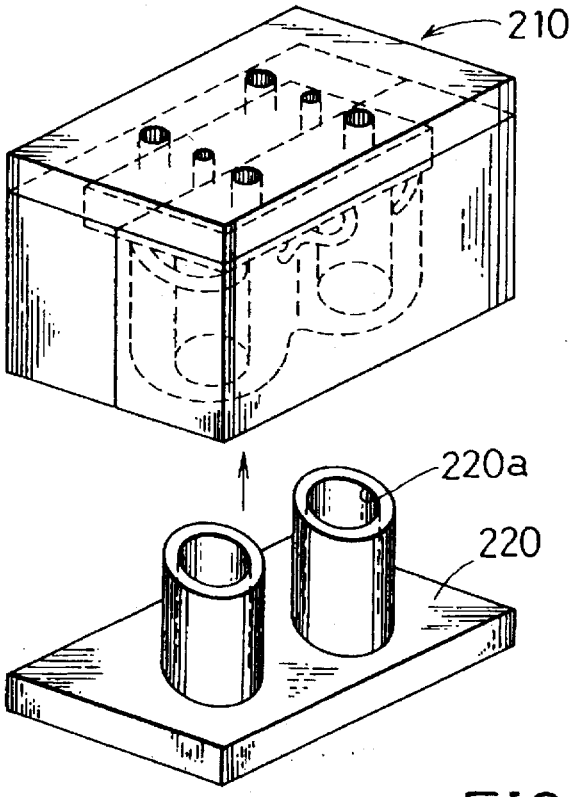
FIG. 8 is an exploded perspective view showing the second die element and the common die.

FIG. 8 schematically shows a second die element 220 used in this embodiment, and FIG. 7 is a sectional view showing the second die element 220 engaged with the common die 210. Designated at 220*a* is a wall defining a molding space 272 for molding a bonded core 274, and at 242 the base core which has been molded in the first molding step. As shown, two distinct second spaces 270 and 272 are defined between the common die 210 and the second die element 220, the second space 272 being for molding the bonded core 274. The base core 242 is accommodated in the second space 270. More specifically, the second spaces 270 and 272 formed between the common die 210 and the second die element 220 include the first molding space 216 and accommodate the base core 242. The second die element 220 thus can be engaged with the common die 210 with the base core 242 accommodated therein.

In the spaces between the common die 210 and the second die element 220, the outer space 270 is not closed to the atmosphere. When the second die element 220 is engaged, the charging port 213*b* which has been closed by the first die element 214 is open, and the core material is charged from this port 213*b* into the second space 272 for molding the bonded core 274, among the second spaces 270 and 272. The charging ports 213*a* and 213*c* which have been used in the first molding step, on the other hand, are held closed by the base core 242. The core material is not charged at this time into the second space 270 because the charging ports 213*a* and 213*c* are held closed by the base core 242. Thus, the second die element 220 need only have such a shape that it can be inserted into the base core 242, and it may have such a shape that it can be readily removed from the complete core after the second molding step. If the charging port 213*b* is not closed by the first die element 214 in the first molding step, it is impossible to charge the core material in the second molding step. In this embodiment, the port 213*b* is closed by the central member 214*a*, so that it is possible to charge the core material in the second molding step for molding the bonded core 274.

In this embodiment, the charging material that is charged from the charging ports 213*a* and 213*c* into the first molding space 216 in the state shown in FIG. 1, is exposed to hardening gas to obtain the base core 242. Then, using the contracting mechanism shown in FIG. 2, the first die element 214 is removed downward without interfering with the base core 242. Then, the second die element 220 is engaged with the common die 210 without interfering with the base core 242 and the common die 210. The base core 242 is accommodated in the second molding space 270 defined between the common die 210 and the second die element 220. Now, the core material is charged from the charging port 213*b* into the bonded core molding space 272 and then exposed to hardening gas, so that the bonded core 274 (i.e., a bore core in this instance) is obtained. The bonded core 274 is bonded to the base core 242 as it is molded, thus obtaining the complete core.

The second die element 220 has a loose outer shape with respect to the base core 242, and it can be removed from the complete core even after the molding of the bonded core 274 therewithin.

Second Embodiment

In this embodiment, two first die elements are used along with a loose piece, which is substituted for the contracting mechanism used for the first die element in the previous embodiment.

Figure 9:
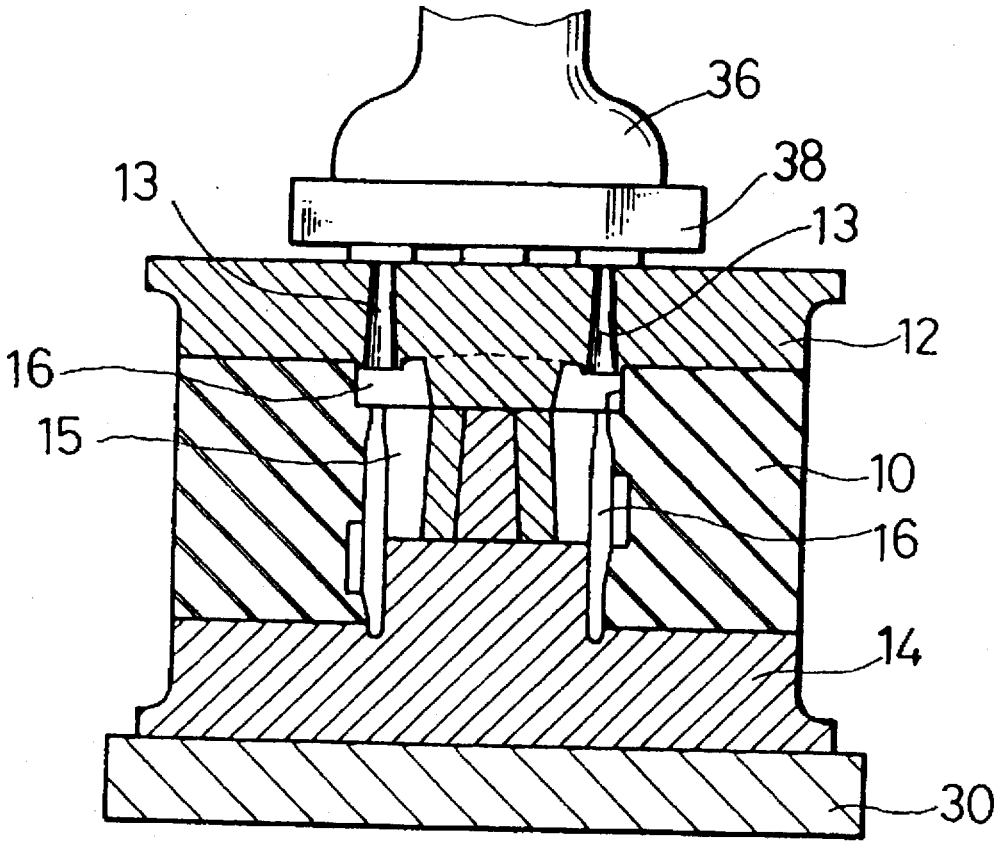
FIG. 9 is a sectional view showing a set-up in a first molding step in a second embodiment of the invention.
Figure 10:
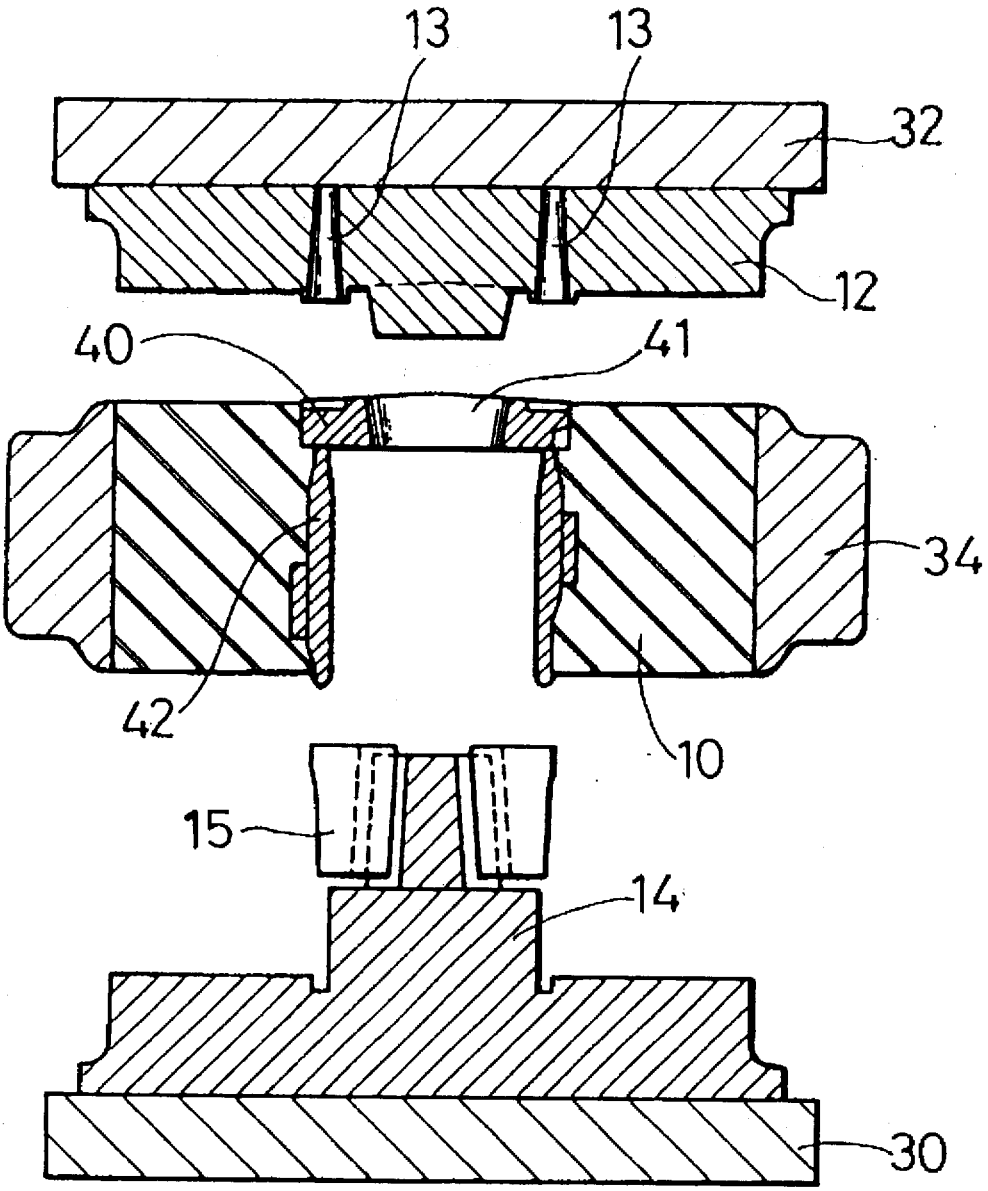
FIG. 10 is a broken-apart sectional view showing the set-up when the first molding step is completed.

FIG. 9 illustrates a first molding step in this embodiment, and FIG. 10 is a view showing the set-up when the first molding step is completed. As shown, on the top of a common die 10, a die element 12 for a slab core is disposed, and on the bottom, a die element 14 for a water jacket core is disposed. The die elements 12 and 14 are "first die elements" in the first molding step, and by engaging these first die elements with the common die 10, a first molding space 16 is defined as shown in FIG. 9.

The die element 12 for the slab core has a plurality of charging ports 13 for charging a core material (i.e., silicate sand) supplied from a charging head 36 of a molding machine into the first molding space 16. The charging head 36 has a charging plate 38 which in turn has holes (not shown) formed at positions aligned to the charging ports 13 of the die element 12.

The die element 14 for the water jacket core is used with a loose piece 15. The loose piece 15 is used to constitute part of the shape of the die element 14 in case when the die element 14 can not be separated from a base core without its use. It is possible to separate the die element 14 from the base core while leaving the loose piece 15 in the base core after the molding of the base core. The loose piece 15 is taken out from the base core after the die element 12 is separated from the common die 10.

Figure 11:
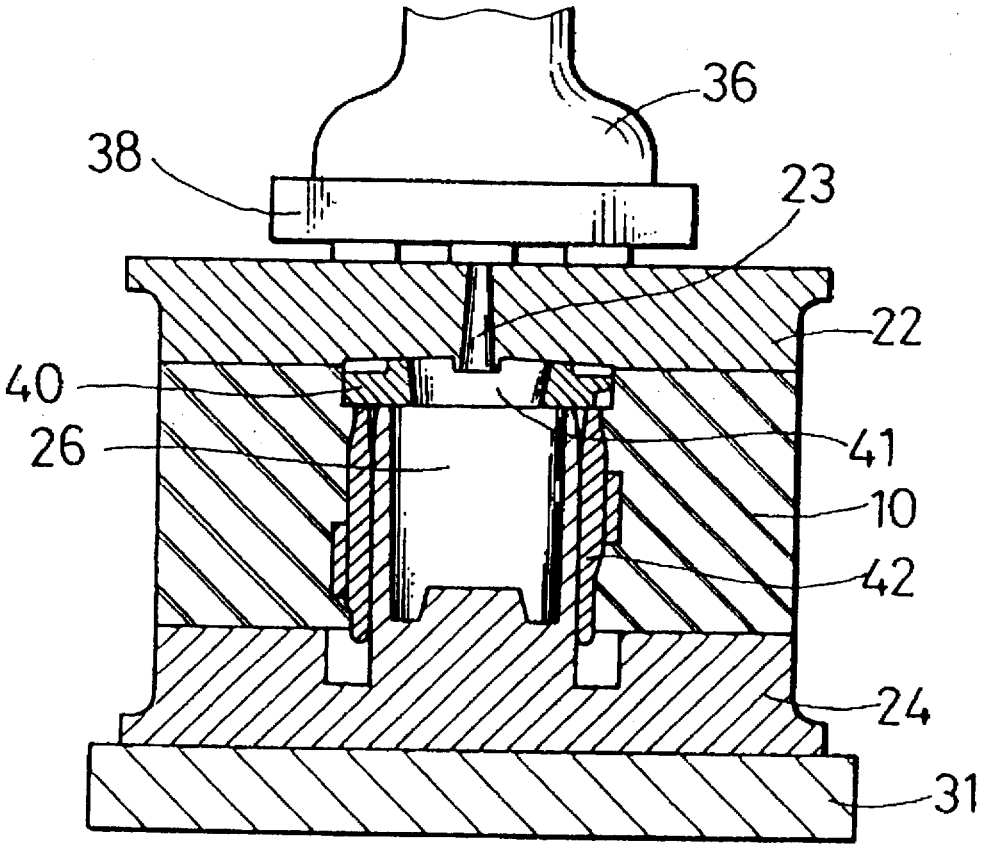
FIG. 11 is a sectional view showing the set-up in a second molding step.
Figure 12:
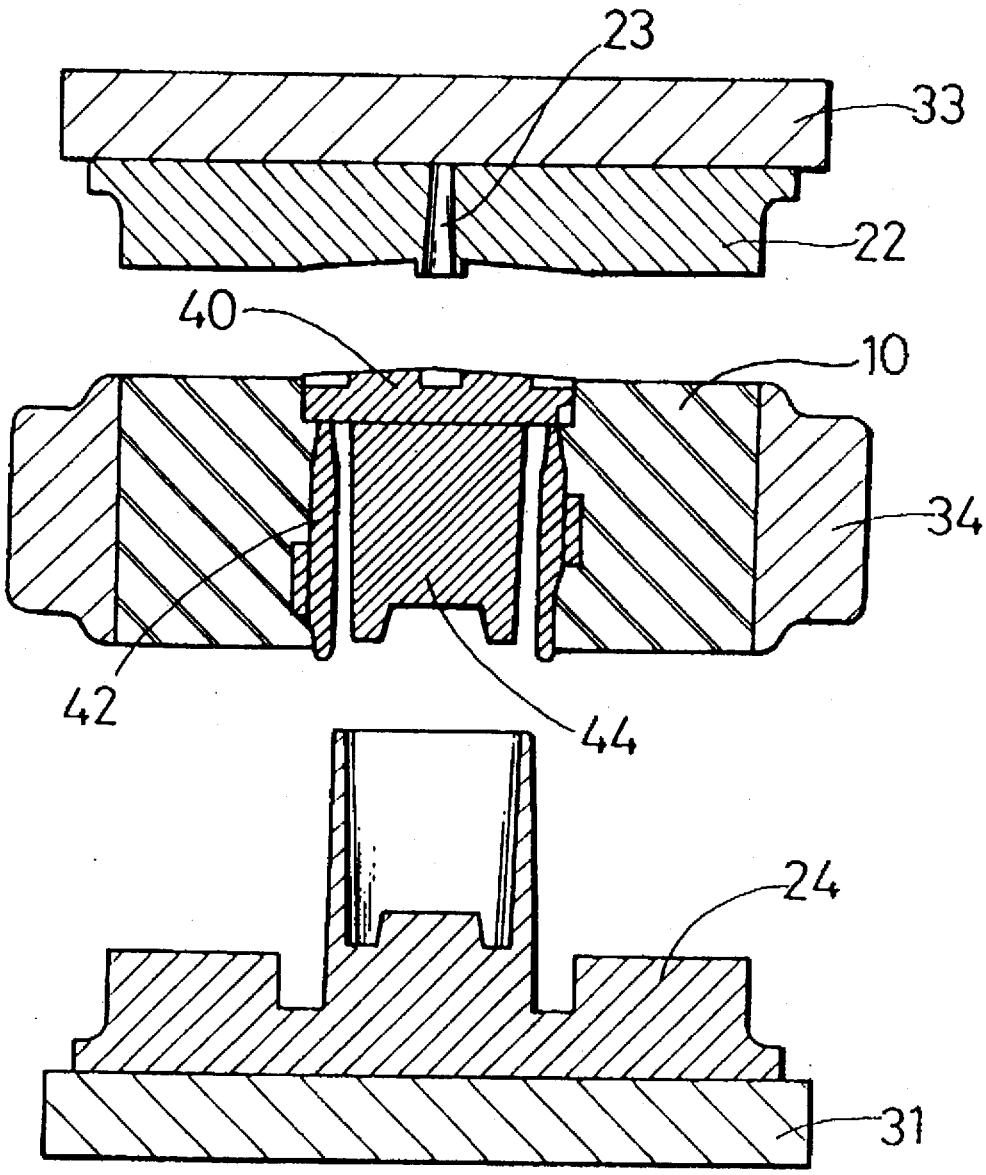
FIG. 12 is a broken-apart sectional view showing the set-up when the second molding step is completed.

FIG. 11 illustrates a second molding step in this embodiment, and FIG. 12 shows the set-up when the second molding step is completed. As shown, for the second molding step, on the top of the same common die 10 as in the first molding step, a slab core die element 22 different from that for the first molding step is disposed, and on the bottom, a die element 24 for a bore core is disposed. These die elements 22 and 24 are "second die elements" in the second molding step. The die elements 12 and 14 are used as first die elements with the common die 10, and the die elements 22 and 24 are used as second die elements. The die element 22 for molding the slab core has a charging port 23 communicated with a bore core molding space. The charging head 36 and the charging plate 38 are used commonly with the first molding step.

The molding operation of this embodiment will now be described.

First, in the first molding step, as shown in FIG. 9, the die element 12 for the slab core and the die element 14 for the water jacket core are engaged with the common die 10. As a result, the first molding space 16 is defined inside the common die 10. The core material is charged from the charging plate 38 of the charging head 36 through the charging port 13 of the die element 12 into the first molding space 16 defined in the common die 10. The charged core material is then hardened by passing catalytic gas therethrough, thus obtaining a base core which has a slab core 40 and a water jacket core 42 integral with each other, as shown in FIG. 11.

Then, the die element 12 for the slab core 40 and the die element 14 for the water jacket core 42 are removed from the common die 10 while leaving the base core comprising the slab core 40 and the water jacket core 42 in the common die 10. For the removal, the slab core die 12 is raised with a die plate 32 of a machine shown in FIG. 10, and then, the common die 10 is raised from the water jacket core die 14 which is disposed on a die base 30, by a die plate 34 different from the die plate 32. The loose piece 15 is removed from the base core.

The slab core 40 and the water jacket core 42 that are molded in the first molding step, constitute the "base core" which is incomplete with respect to a complete core which can be used for the casting of cylinder block. The slab core 40 of the "base core" has a hole 41 formed in conformity to the shape of the slab core die 12. The hole 41 is used when charging core material in a subsequent second molding step in this embodiment.

The common die 10 with the slab core 40 and the water jacket core 42 left therein is fed to the second molding step. For the second molding step, as shown in FIG. 11, the die element 22 for the slab core and the die element 24 for the bore core are engaged with the common die 10, thus defining a second molding space 26 with a high position accuracy with respect to the "base core" in the common die 10. The base core is accommodated in the second molding space between the common die 10 and the second die elements 22 and 24.

The core material is then charged from the charging head 36 through the charging plate 38, the charging ports 23 of the die element 22 and the hole 41 of the slab core 40 into the second molding space 26. Like the first molding step, the charged core material is hardened with catalytic gas, thus obtaining the bore core 44 bonded to the slab core 40 as shown in FIG. 12. At this time, the core material fills the hole 41 of the slab core 40 and is hardened to be integral therewith.

The bore core 44 molded in the second molding step is the "bonded core" which is bonded to the "base core" molded in the first molding step. The complete core which can be used for the casting of the cylinder block is obtained from the "base core" and the "bonded core" as these cores are bonded together.

After the second molding step, like the first molding step, the die element 22 for the slab core is raised from the common die 10 by a die plate 33, and then, the common die 10 is raised from the die element 24 disposed on the die base 31 by a die plate 34. Now, the complete core can be taken out from the common die 10, thus bringing an end to the molding operation.

With the complete core molded in the above molding method, the accuracy of positioning of the water jacket core 42 and the bore core 44 with respect to the slab core 40 is extremely improved. The accuracy of positioning of the water jacket core 42 and the bore core 44 is very important from the standpoint of improving the thickness accuracy between the water jacket and the bore in the cylinder block which is cast using the complete core.

By way of example, with a cylinder block cast using a complete core, which was obtained by individually molding a slab core, a water jacket core and a bore core in a shell molding process and assembling these cores by "core print positioning", the fluctuations of the thickness between the water jacket and the bore were 1.0 to 1.2 mm, whereas in case of using the complete core molded in this embodiment of the molding process, the fluctuations were 0.5 mm or below.

Third Embodiment

Figure 13:
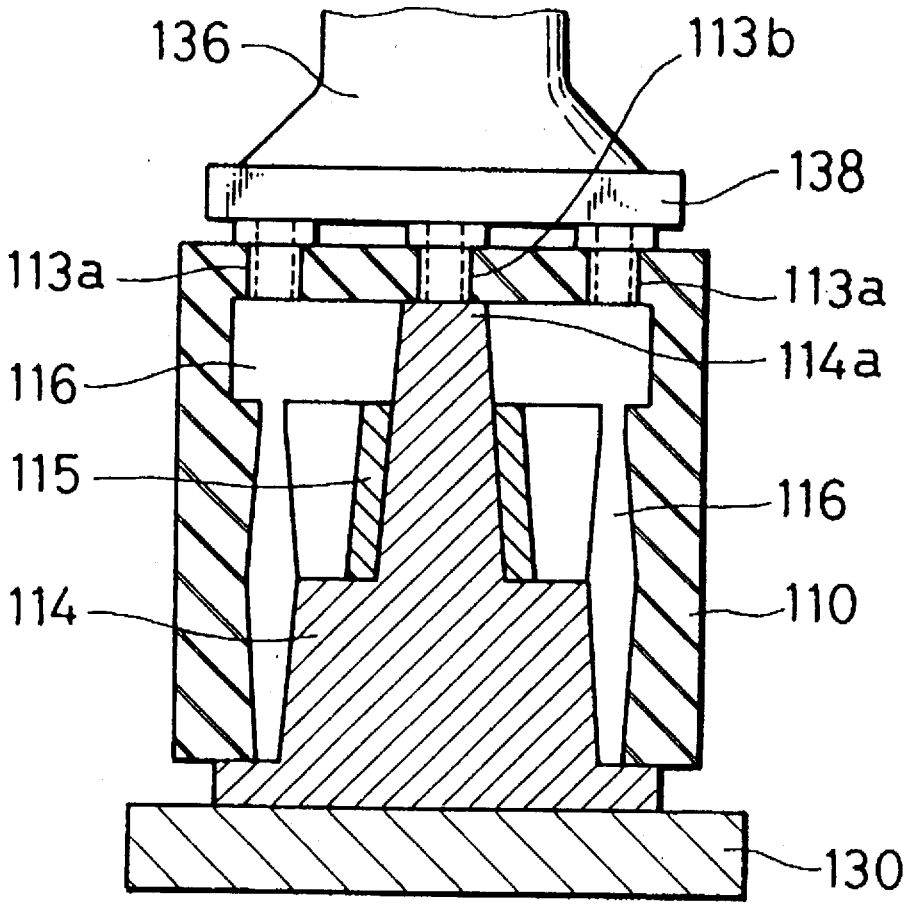
FIG. 13 is a sectional view showing a set-up in a first molding step in a third embodiment of the invention.
Figure 14:
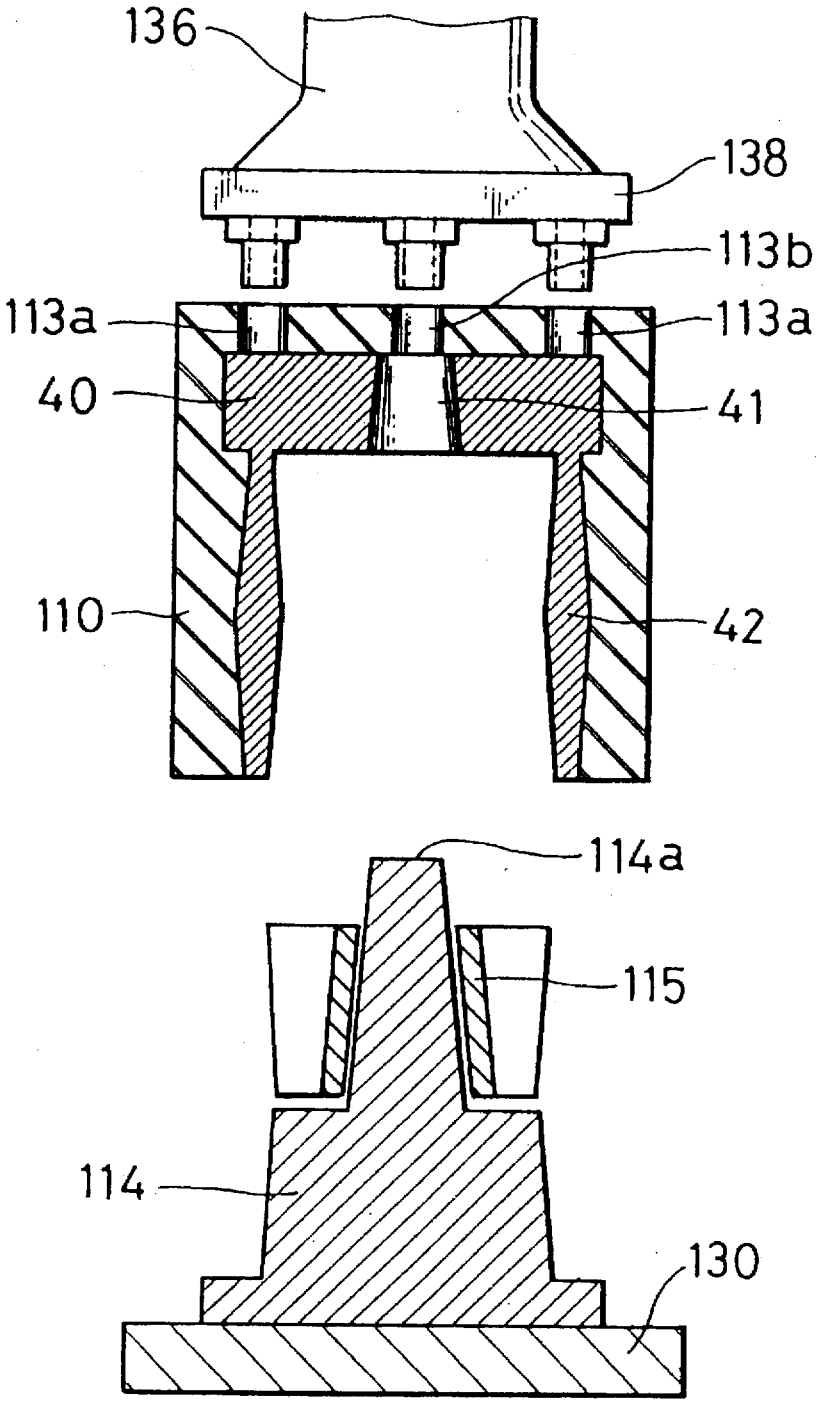
FIG. 14 is a sectional view showing the set-up in the third embodiment when the first molding step is completed.

FIG. 13 shows a first molding step in a third embodiment of the invention, and FIG. 14 shows the set-up when the first molding step is completed. As is seen from these figures, a common die 110 in this embodiment serves the role of the die element 12 for the slab core in the previous second embodiment. Beneath the common die 110 is disposed a die element 114 for a water jacket core which is set on a die base 130. This die element 114 is a "first die element" in the first molding step. A molding space 116 for molding a "base die" is defined by engaging this die element 114 with the common die 110 as shown in FIG. 13.

The top wall of the common die 110 has a plurality of charging ports **113*a* and 113*b* for charging a core material from a charging head 136 through a charging plate 138. Through the charging hole 113*a*, the core material is charged from the charging head 136 into the molding space 116 for molding the "base core" in the first molding step. Through the charging port 113b, the core material is charged from the charging head 136 into a molding space 126 for molding a "bonded core" in a second molding step to be described hereinunder. At the time of the die engagement shown in FIG. 13, the charging port 113b is closed by the upper end 114a of the first die element 114 for a water jacket core. Like the previous second embodiment, a loose piece 115 is used with the first die element 114**.

Figure 15:
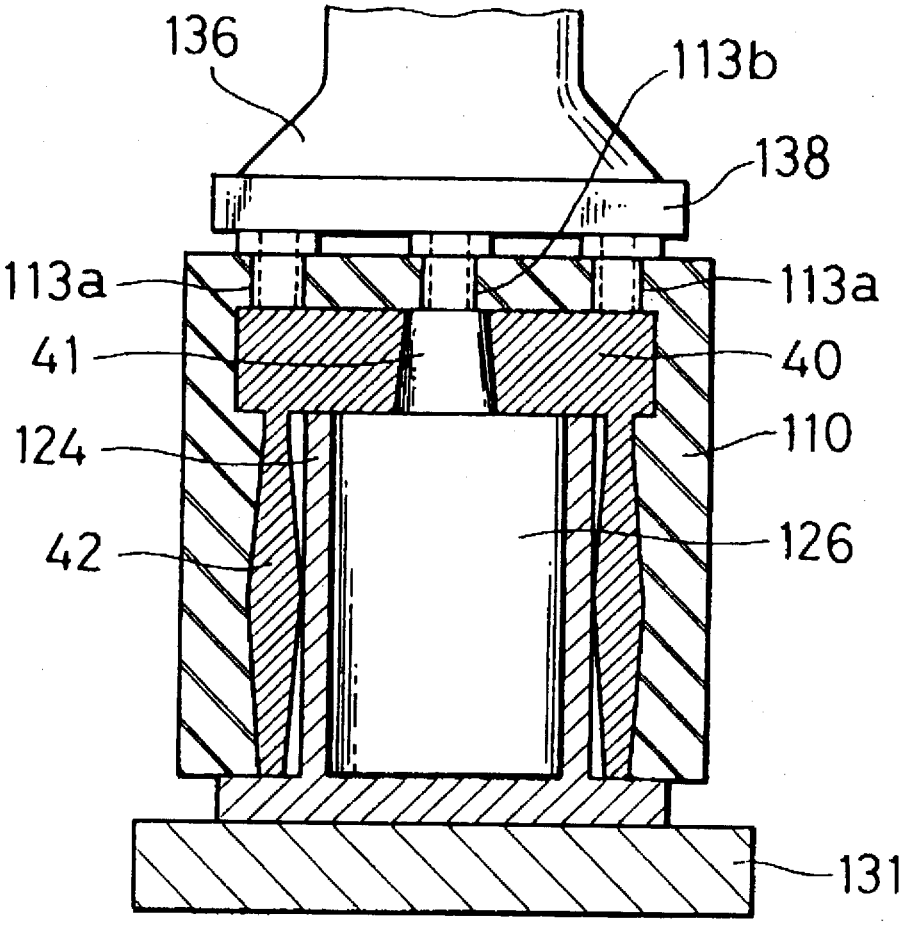
FIG. 15 is a sectional view showing the set-up in a second molding step in the third embodiment.
Figure 16:
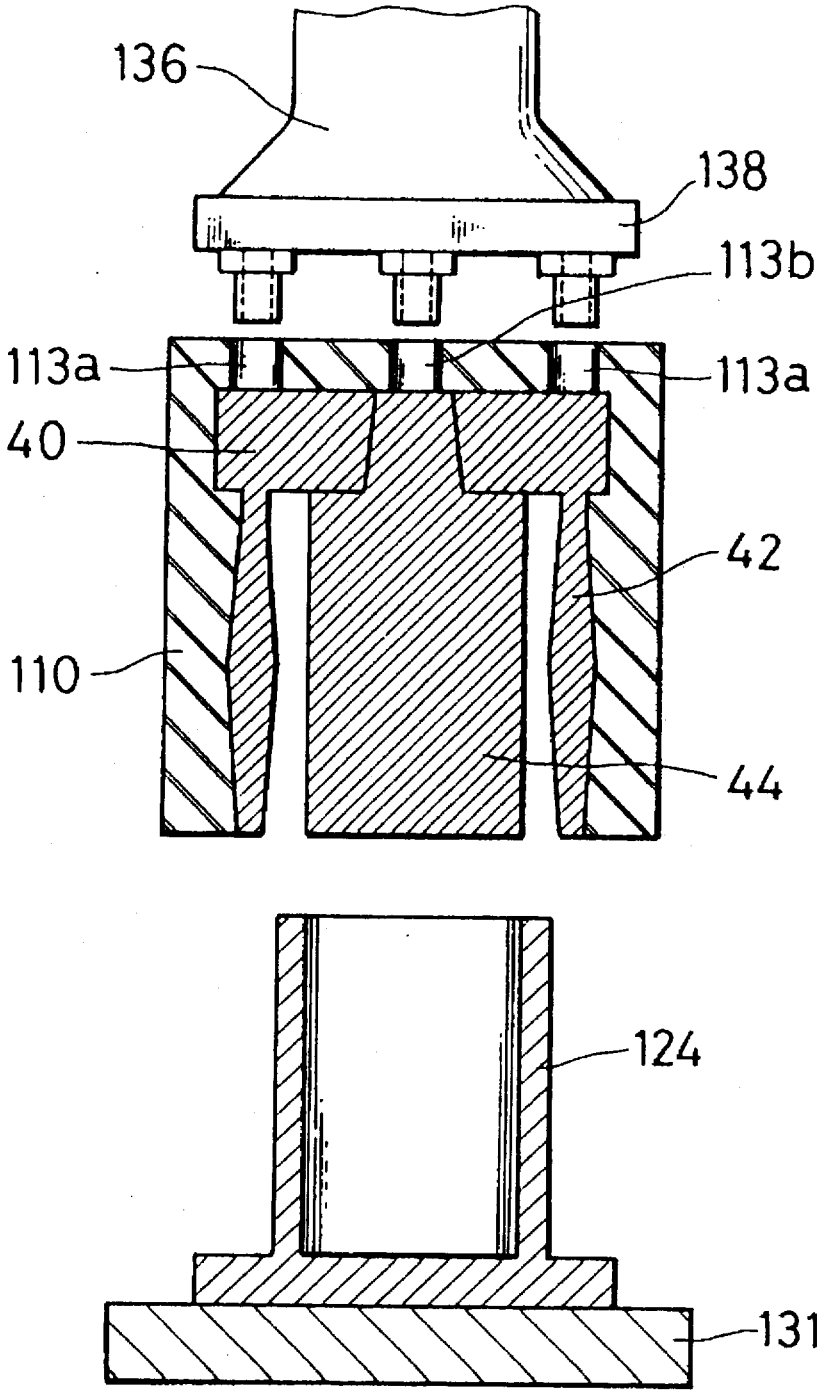
FIG. 16 is a sectional view showing the set-up in the third embodiment when the second molding step is completed.

FIG. 15 shows a second molding step in this embodiment, and FIG. 16 shows the set-up when the second molding step is completed. As shown, for the second molding step, a die element 124 for a bore core, set on a die base 131, is disposed beneath the common die 110 as used in the first molding step. This die element 124 is a "second die element" in the second molding step, and a molding space 126 for molding the "bonded core" is defined by engaging the die element 124 with the common die 110 as shown in FIG. 15.

The molding operation will now be described. In the first molding step, as shown in FIG. 13, the core material is charged from the charging head 136 through the charging port 113a of the common die 110 into the first molding space 116 with the other charging port 113b held closed by the top 114a of the first die element 114 for the water jacket. After the core material has been hardened, the charging head 136 and the charging plate 138 are separated upward while separating the die plate 130 together with the die 114 as shown in FIG. 14. As a result, the slab core 40 and the water jacket 42, which constitute the "base core", are left in the common die 110.

It is possible as well to carry out the second molding step without separating the charging head 136 and the charging plate 138 from the common die 110.

For the second molding step, the second die element 124 for the bore core is engaged with the common die 110 with the "base core" left therein as shown in FIG. 15. As a result, the molding space 126 is defined in the common die 110 with high positioning accuracy with respect to the "base core" noted above. In this case, the charging port 113a which has been used in the first molding step, is held closed by the slab core 40 of the "base core", so that the core material is charged from the charging head 136 through the charging port 113b and the hole 41 in the slab core 40 into the second molding space 126 alone. In other words, no core material is charged into the clearance between the second die element 124 and the base core 42. This means that the second die element 124 may have an outer shape such that it can be readily removed from the base core 42. When the core material in the second molding space is hardened, a bore core 44 which is the "bonded core" is obtained such that it is bonded to the slab core 40 as shown in FIG. 16. Afterwards, as shown in FIG. 16, the charging head 136 and the charging plate 138 are separated upward while separating the die plate 131 together with the second die element 124 downward, and the complete core is taken out from the common die 110 by opening the die 110, thus bringing an end to the molding operation.

This embodiment does not use the first die element 12 and the second die element 22 for molding the slab core in the previous second embodiment. It is possible as well, however, a single kind of die element which is common to the first and second molding steps can be used as in the first embodiment. In this case, only a single common die is necessary, and it is thus possible to reduce the installation cost. In addition, changing of die elements for every molding step is unnecessary, and the machine construction can be simplified.

Figure 17:
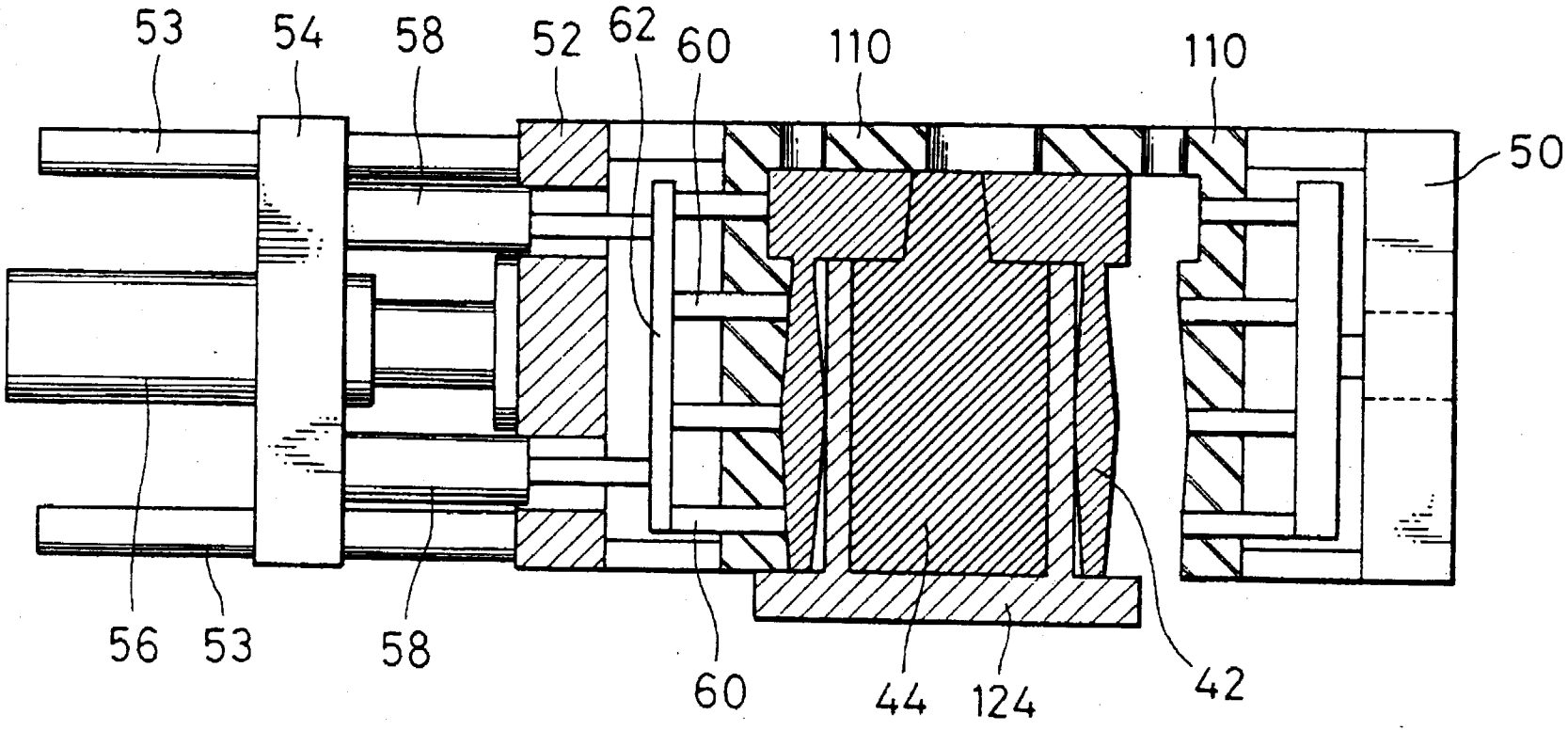
FIG. 17 is a view showing a step of opening a common die.

FIG. 17 illustrates a step of opening the common die 110. As shown, the common die 110 comprises a left part and a right part. One of these parts, i.e., the right part, is supported by a stationary vice 50, while the other is supported by a movable vice 52. The movable vice 52 is assembled to a stationary frame 54 of a machine such that it is movable to the left and right along a plurality of guide rods 53. The movable vice 52 is driven by a vice cylinder 56 mounted on the stationary frame 54. Push cylinders 58 are mounted on the stationary frame 54 to drive a plurality of push pins 60 secured to a coupling plate 62 in the same direction as the movable vice 52 (i.e., to the left and right in the FIG. 17).

For taking out the complete core from the common die 110 by opening the common die 110, the push pins 60 are advanced by the push cylinder 58 by leaving the second die element 124 used in the second molding step in the "complete core", and the push pins 60 are held at a predetermined position. To hold the push pins 60, generally a lock means is adopted, which uses a lock mechanism (not shown) for locking the push cylinders 58. In FIG. 17, the push pins 60 are shown as they are held at their advanced position.

Afterwards, the movable vice 52 is displaced by the vice cylinder 56 to the left. From this state, the movable vice 52 is further moved to the left to the fully open position. During this opening stroke, the complete core is pushed apart from the common die 110 by the push pins 60. The separation of the complete core from the common die 110 is completed with the complete core and the second die element 124 left in a central part.

The advanced position of the push pins 60 should be located at an intermediate point in the opening stroke the movable vice 52. However, when the required pushing stroke of the push pins 60 is less than the opening stroke of the movable vice 52, the movable vice 52 may be brought to strike the coupling plate 62 of the push pins 60 upon reaching of the required pushing stroke, and then, the push pins 60 may be displaced together with the movable vice 52.

As shown, in the die separating operation, the second die element 124 is held in the complete core, and the push pins 60 are held at a fixed position. With this arrangement, it is possible to avoid such a problem as breakage of the complete core during the separating operation. With a complete core which has a cavity between the water jacket core 42 and the bore core 44, the pushing operation of the push pins 60 caused by the push cylinders 58 may cause tilting of the coupling plate 62 due to such cause as fluctuations of the resistance offered to the push pins 60. In such a case, variations of the pushing stroke of the push pins 60 may occur to cause cracking of the complete core having the cavity. The die separating means shown in FIG. 17 can preclude such a problem.

The operation to hold the push pins 60 at a fixed position in the die separating operation can dispense with any guide rod or the like that may otherwise be used to maintain stable orientation of the coupling plate 62 during the pushing operation of the push pins 60 caused by the push cylinders 58. Moreover, leaving the second die element 124 for the second molding step in the complete core permits preparations for the next molding cycle by setting the first die element 114 for the first molding step in the machine during the die separating operation. This can lead to a reduced molding cycle.

It is conceivable to apply each of the above embodiments of the molding process to a shell molding process. In the shell molding, the core material is hardened by heating it to a high temperature (of 250° to 380° C.), and the core molded in the first molding step is heated again to a high temperature in a second molding step. Therefore, the core material undergoes carburetion of its component and may become fragile. In addition, deformation of each die by heating to a high temperature can not be ignored. The accuracy of the core may be reduced by these causes. By solving these problems, the embodiments of the molding process according to the invention is applicable to the shell molding process.

While the above embodiments are concerned with the molding of the complete core in the first and second molding steps, it is possible as well to obtain the complete core by molding the "base core" in a first molding step and molding the "bonded core" in two or more molding steps. Furthermore, the core as the subject of molding is not limited to the process of molding cores used for the casting of cylinder blocks.

The process of core molding according to the invention is best suited for molding a core to be used for a cast product requiring high thickness accuracy, such as the wall between a bore and a water jacket of an automotive engine cylinder block. In addition, it permits avoiding such trouble as breakage of the base core that is molded beforehand or breakage of the complete core at the time of the die opening.

While some preferred embodiments of the invention have been described, it is to be construed that changes and modifications may be made in the details of the design without departing from the spirit and scope of the invention as set forth in the appended claims.

What is claimed is:

1. A process of molding a complete core comprising a base core and a bonded core bonded thereto, comprising the steps of:

preparing a common die, a first die element defining a first molding space corresponding to the base core when engaged with the common die, and a second die element defining a second molding space including the first molding space and a space corresponding to the bonded core when engaged with the common die;

engaging the first die element with the common die;

molding the base core by charging a core material into the first molding space;

removing the first die element from the common die with the base core left in the common die and then engaging the second die element with the common die; and molding the bonded core by charging the core material into the second molding space such that the bonded core is bonded to the base core.

2. The process according to claim 1, wherein some of a plurality of core material charging ports formed in the common die are closed by the first die element when the first die element is engaged with the common die.

3. The process according to claim 2, wherein the core material is charged into the second molding space from a core material charging port which has been closed by the first die element.

4. The process according to claim 1, wherein when taking out the complete core from the common die by opening the common die, a push pin is held at an intermediate position in a stroke of opening the common die, and the second die element is removed after opening the common die.

5. The process according to claim 1, wherein at least either the first die element or the second die element includes a contracting mechanism operable such that the die element with the contracting mechanism is removed without interfering with the molded core.

6. The process according to claim 1, wherein the common die has inner surfaces corresponding to outer surfaces of a water jacket core, the first die element has outer surfaces corresponding to inner surfaces of the water jacket core, the second die element has outer surfaces defining a clearance with the molded base core and can be removed without interference with the water jacket core, and the second die element has inner surfaces corresponding to outer surfaces of a cylinder bore core.

7. The process according to claim 5, wherein the core material is charged into the second molding space without being charged into the clearance between the outer surfaces of the second die element and the molded base core as a result of closing of some of the core material charging ports by the base core.

* * * * *